US008393116B2

(12) United States Patent
Reeve et al.

(10) Patent No.: US 8,393,116 B2
(45) Date of Patent: Mar. 12, 2013

(54) ELEVATED PLATFORM SYSTEMS INCLUDING FIBER REINFORCED COMPOSITE PANELS

(75) Inventors: Scott R. Reeve, Dayton, OH (US); Andrew K. Loff, Huber Heights, OH (US); Shawn Beamish, Edmonton (CA)

(73) Assignees: Composite Advantage, LLC, Dayton, OH (US); Canadian Mat Systems, Inc., Edmonton (CA)

( * ) Notice: Subject to any disclaimer, the term of this patent is extended or adjusted under 35 U.S.C. 154(b) by 0 days.

(21) Appl. No.: 13/408,351

(22) Filed: Feb. 29, 2012

(65) Prior Publication Data

US 2012/0159867 A1 Jun. 28, 2012

Related U.S. Application Data

(63) Continuation of application No. PCT/US2011/054192, filed on Sep. 30, 2011.

(60) Provisional application No. 61/388,133, filed on Sep. 30, 2010.

(51) Int. Cl.

| | |
|---|---|
| ***B32B 27/04*** | (2006.01) |
| ***B32B 5/16*** | (2006.01) |
| ***D03D 15/00*** | (2006.01) |
| ***D03D 9/00*** | (2006.01) |
| ***D04H 3/00*** | (2012.01) |
| ***D04H 1/00*** | (2006.01) |
| ***E04H 3/10*** | (2006.01) |
| ***E04D 13/00*** | (2006.01) |
| ***E04B 1/98*** | (2006.01) |
| ***E02D 27/00*** | (2006.01) |
| ***E04B 1/70*** | (2006.01) |
| ***E04F 15/22*** | (2006.01) |

(52) U.S. Cl. ..... 52/6; 52/167.1; 52/169.9; 52/302.1; 52/403.1; 442/6; 442/52; 442/229; 442/377; 428/323; 428/300.1; 428/300.7

(58) Field of Classification Search ..... 442/6, 8, 442/21, 52, 229, 377, 417; 428/323, 300.7, 428/300.1; 52/6, 11, 167.1, 169.9, 299, 302.1, 52/403.1, 480, 650.3
See application file for complete search history.

(56) References Cited

U.S. PATENT DOCUMENTS 2,772,560 A * 12/1956 Neptune ..... 52/707
(Continued)

FOREIGN PATENT DOCUMENTS

JP 4182562 6/1992
WO WO 0216282 A1 * 2/2002

OTHER PUBLICATIONS

International Search Report and Written Opinion dated Apr. 20, 2012 pertaining to International Application No. PCT/US2011/054192.

*Primary Examiner* — Brian Glessner
*Assistant Examiner* — Omar Hijaz
(74) *Attorney, Agent, or Firm* — Dinsmore & Shohl LLP

(57) ABSTRACT

An elevated platform system includes a base support structure and a plurality of fiber reinforced polymer composite panels. The base support structure includes pilings secured to a ground surface and attachment cradles coupled to the pilings. The attachment cradles are in electrical continuity with the ground surface. The fiber reinforced polymer composite panels include a panel body portion, fibrous material surrounding the panel body portion, a non-conductive matrix forming at least a portion of an outer-most layer of the fiber reinforced polymer composite panel, and an electrically-conductive layer at least partially embedded in the non-conductive matrix. The fiber reinforced polymer composite panels are coupled to the attachment cradles, such that the electrically-conductive layer of the fiber reinforced polymer composite panel is in electrical continuity with the ground surface.

23 Claims, 4 Drawing Sheets

U.S. PATENT DOCUMENTS 4,484,250 A * 11/1984 Rzepecki et al. ..... 361/220
4,564,745 A * 1/1986 Deschenes ..... 219/213
4,702,951 A * 10/1987 Rooklyn ..... 428/193
4,770,916 A * 9/1988 Leukel et al. ..... 428/95
4,784,908 A * 11/1988 Ungar et al. ..... 428/332
4,802,056 A * 1/1989 Aronson ..... 361/212
4,855,865 A * 8/1989 Rooklyn ..... 361/212
5,275,876 A * 1/1994 O'Dell et al. ..... 428/301.4
5,317,476 A * 5/1994 Wallace et al. ..... 361/220
5,447,784 A * 9/1995 Williams et al. ..... 428/220
5,657,595 A 8/1997 Fyfe et al.
6,081,955 A 7/2000 Dumlao et al.
6,247,281 B1 * 6/2001 Lin ..... 52/309.4
6,941,702 B1 * 9/2005 Abrams et al. ..... 52/16
7,018,706 B2 * 3/2006 Lee ..... 428/216
7,360,343 B1 * 4/2008 Spransy et al. ..... 52/263
7,410,327 B2 8/2008 Baugh et al.
2002/0066549 A1 * 6/2002 Schulz et al. ..... 165/53
2002/0122954 A1 9/2002 Dagher
2002/0178661 A1 * 12/2002 Burke et al. ..... 52/177
2004/0084103 A1 * 5/2004 Tsotsis ..... 139/420 R
2004/0182036 A1 * 9/2004 Sjoberg et al. ..... 52/592.1
2005/0076601 A1 * 4/2005 Meadowcroft ..... 52/633
2005/0144903 A1 * 7/2005 Ceria ..... 52/782.1
2006/0000159 A1 * 1/2006 Tsai ..... 52/167.4
2007/0256379 A1 * 11/2007 Edwards ..... 52/309.9
2008/0005988 A1 * 1/2008 Dombowsky ..... 52/314
2009/0200285 A1 * 8/2009 Raidt et al. ..... 219/213

* cited by examiner

ELEVATED PLATFORM SYSTEMS INCLUDING FIBER REINFORCED COMPOSITE PANELS

CROSS-REFERENCE TO RELATED APPLICATIONS

This application is a continuation of PCT Application Serial No. PCT/US11/54192 filed Sep. 30, 2011, titled "Elevated Platform Systems Including Fiber Reinforced Composite Panels" which claims priority to U.S. Provisional Application Ser. No. 61/388,133 filed Sep. 30, 2010, titled "Composite Panels and Drilling Platforms Incorporating Composite Panels."

BACKGROUND

The present disclosure is generally directed to elevated platform systems including reinforced composite panels and, more particularly, elevated platform systems including static electricity dissipative features.

SUMMARY

Elevated platforms provide a base for oil exploration equipment to be stabilized during drilling operations. The elevated platforms reduce environmental impact to the ground surface surrounding the drilling area by minimizing contact between the oil exploration equipment and the ground surface itself.

The inventors have identified that elevated platform systems that include fiber reinforced polymer composite panels are well suited for oil exploration applications. Fiber reinforced polymer composite panels are generally impervious to the weather and machine traffic that are experienced in such an application. Further, fiber reinforced polymer composite panels may weigh less than a comparable steel-based panel, allowing for fiber reinforced polymer composite panels to be constructed to be larger than the comparable steel-based panel. Further, the reduction in weight due to the use of fiber reinforced polymer composite panels decrease the number of support pylons that are required to be driven into the ground surface, reducing the cost of assembling an elevated platform at a oil exploration site and further reducing the potential for environmental impact.

The inventors have identified that providing an electrical conduction path from the elevated platform to the ground surface may be desirable. Such an electrical conduction path dissipates any static electricity that builds on the surface of the fiber reinforced polymer composite panel, and discharges the static electricity into the ground surface. Accordingly, elevated platform systems capable of discharging static electricity from a fiber reinforced polymer composite panel are desired.

In one embodiment, an elevated platform system includes a base support structure and a plurality of fiber reinforced polymer composite panels. The base support structure includes pilings secured to a ground surface and attachment cradles coupled to the pilings. The attachment cradles are in electrical continuity with the ground surface. The fiber reinforced polymer composite panels include a panel body portion, fibrous material surrounding the panel body portion, a non-conductive matrix forming at least a portion of an outermost layer of the fiber reinforced polymer composite panel, and an electrically-conductive layer at least partially embedded in the non-conductive matrix. The fiber reinforced polymer composite panels are coupled to the attachment cradles, such that the electrically-conductive layer of the fiber reinforced polymer composite panel is in electrical continuity with the ground surface.

In another embodiment, a fiber reinforced polymer composite panel includes a panel body portion including a deck portion and a plurality of beam portions arranged along a lower deck side. Fibrous material surrounds the panel body portion and a non-conductive matrix forms at least a portion of an outer-most layer of the fiber reinforced polymer composite panel. The fiber reinforced polymer composite panel further includes an electrically-conductive layer at least partially embedded in the non-conductive matrix.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
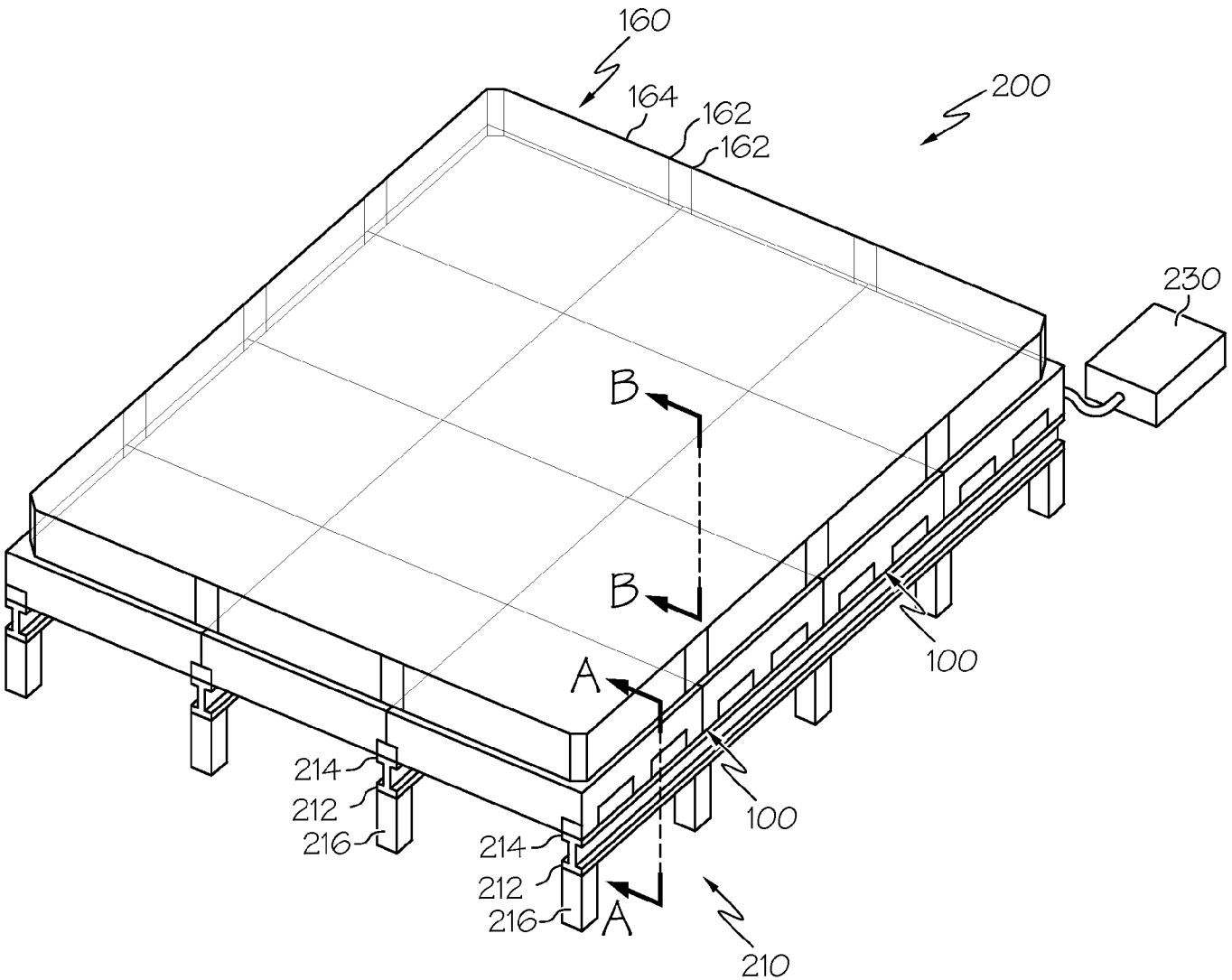
FIG. 1 depicts a perspective side view of an elevated platform system according to one or more embodiments shown and described herein.

Referring to FIG. 1, an elevated platform system incorporating fiber reinforced polymer composite panels is depicted. The elevated platform system includes a base support structure that is secured to a ground surface, and a plurality of fiber reinforced polymer composite panels that are secured to the base support structure. The fiber reinforced polymer composite panels include an electrically-conductive layer that is at least partially embedded in a non-conductive matrix. When the fiber reinforced polymer composite panels are coupled to the base support structure, the electrically-conductive layers of the fiber reinforced polymer composite panels are in electrical continuity with the ground surface. The elevated platform system will be described in more detail herein with specific reference to the appended drawings.

Figure 2:
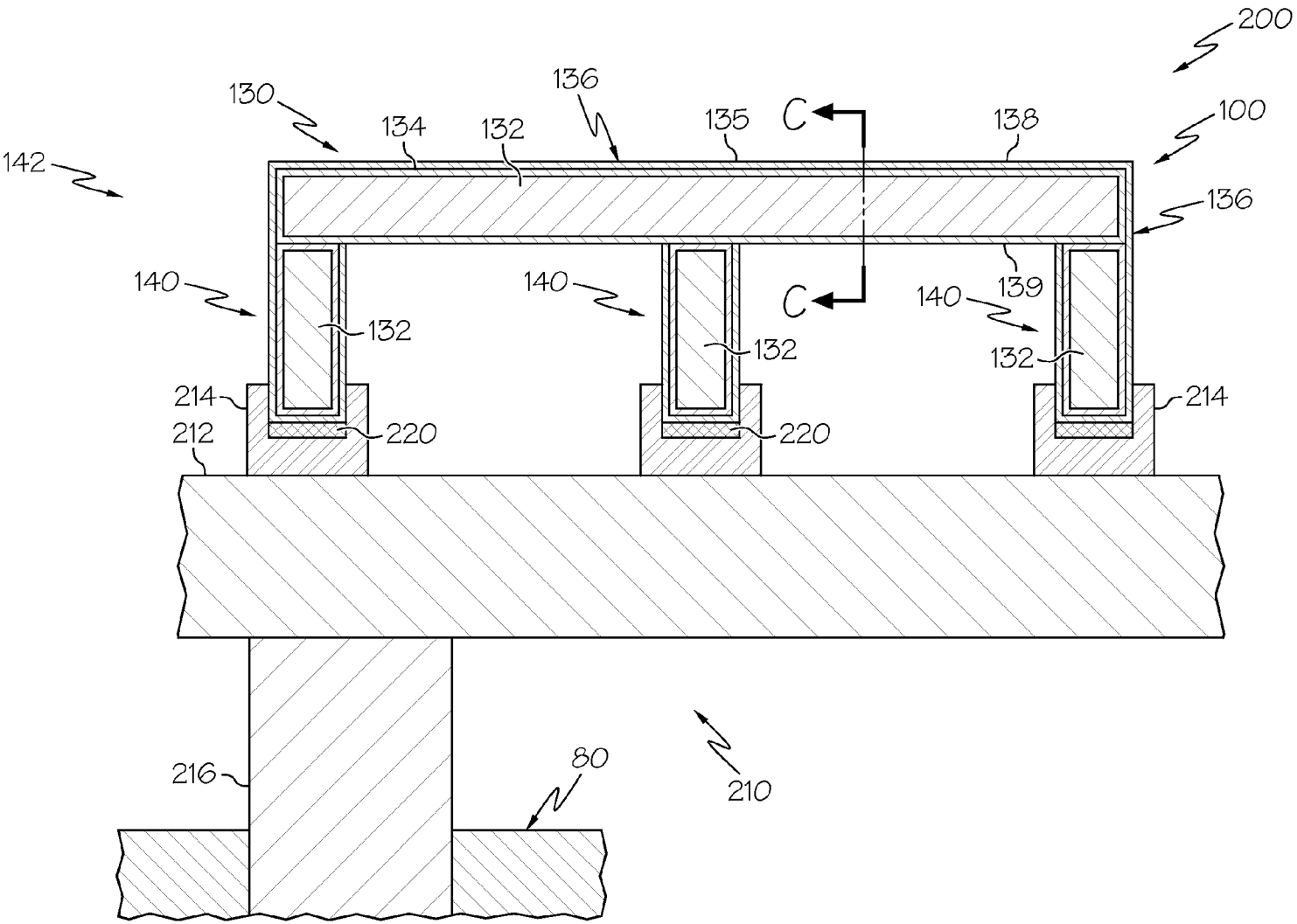
FIG. 2 depicts a sectional side view of the elevated platform system of FIG. 1 along line A-A.

Referring to FIGS. 1 and 2 in detail, the elevated platform system 200 includes a base support structure 210 and a plurality of fiber reinforced polymer composite panels 100 coupled to the base support structure 210. The base support structure 210 includes pilings 216 that are affixed to a ground surface. The pilings 216 are driven a depth into the ground surface such that the pilings 216. The base support structure 210 also includes beams 212 that extend across and are coupled to multiple pilings 216. At locations along the beams 212, attachment cradles 214 are coupled to the beams 212. The attachment cradles 214 allow for the fiber reinforced polymer composite panels 100 to be secured to the pilings 216. As illustrated in FIGS. 1 and 2, the attachment cradles 214 have an upwards facing "U" shape. However, other shapes and attachment methods are contemplated.

The attachment cradles 214 are in electrical continuity with the ground surface 80. In the embodiment illustrated in FIGS. 1 and 2, the attachment cradles 214, the beams 212, and the pilings 216 are all made from electrically-conducting materials, for example steel or aluminum. In another embodiment, the attachment cradles 214 may be electrically coupled with the ground surface 80 by a grounding wire. In this embodiment, the beams 212 and/or the pilings 216 may be made from electrically insulating materials.

Figure 3:
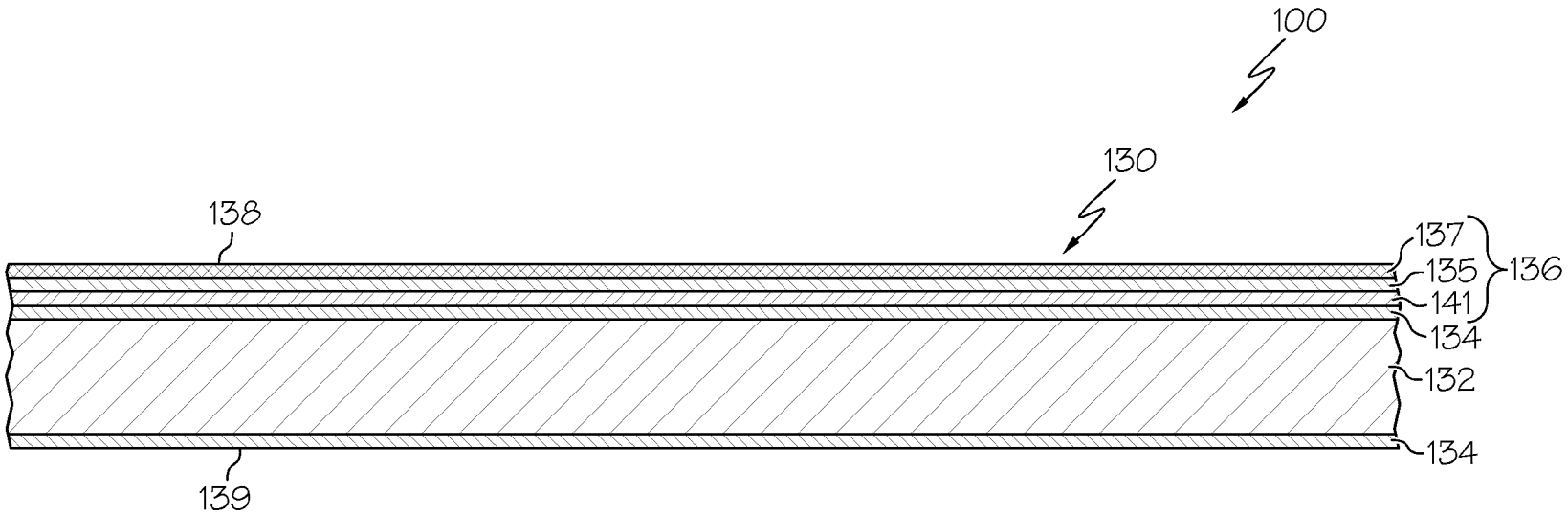
FIG. 3 depicts a sectional side view of a fiber reinforced polymer composite panel of an elevated platform system of FIG. 2 along line C-C.

The fiber reinforced polymer composite panels 100 are shown in schematic detail in FIGS. 2 and 3. The fiber reinforced polymer composite panels 100 include a panel body portion 132, fibrous material 134 surrounding the panel body portion 132, and a non-conductive matrix 136 forming at least a portion of an outer-most layer of the fiber reinforced polymer composite panel 100. The non-conductive matrix 136 comprises a single or multi-component matrix of single or multi-layer construction. The fiber reinforced polymer composite panels 100 further includes an electrically-conductive layer 135 that is at least partially embedded in the non-conductive matrix 136.

In some embodiments, the electrically-conductive layer 135 includes a metallic mesh, for example, a copper or an aluminum mesh. In other embodiments, the electrically-conductive layer 135 includes a carbon-based veil, or a non-woven carbon fabric. In yet other embodiments, the electrically-conductive layer 135 includes electrically-conductive particles dispersed in the non-conductive matrix 136. Examples of such electrically-conductive particles include iron-alloy filings, carbon powder, and nanocomposite additives.

Embodiments of the fiber reinforced polymer composite panels 100 illustrated in FIGS. 1 and 2 include a deck portion 130 and beam portions 140 extending from the lower deck side 139 of the deck portion 130. The beam portions 140 may provide additional strength to the fiber reinforced polymer composite panels 100 and may increase the loading capable of being supported by the elevated platform system 200. Other embodiments of the fiber reinforced polymer composite panels 100 may include only deck portions 130, without beam portions 140.

In general, the fiber reinforced polymer composite panels 100 may be manufactured using a vacuum resin infusion process. Dry fibrous material 134, for example fiber glass, is sandwiched around a panel body portion 132. The panel body portion 132 can be any suitable internal core material. Upon completion of the dry fibrous material 134 lay-up, a polymeric bag material is seal over the entire dry assembly and a vacuum is pulled. Wet (i.e., uncured) non-conductive matrix 136 material, for example, thermoset resin including, but not limited to, vinyl ester resin, polyester resin, or epoxy resin, is then pushed through the dry material held captive under vacuum in the polymeric bag. Atmospheric pressure encourages wetting of the dry fibrous material 134 by the wet non-conductive matrix 136 material. Once the resin is completely infused into the fibrous material 134, the non-conductive matrix 136 cures and solidifies. Depending on the design of the fiber reinforced polymer composite panels 100, the above-described manufacturing process can be subsequently repeated to attach additional sub-components that form the fiber reinforced polymer composite panels 100.

Fiber reinforced polymer composite panels 100 manufactured according to the above-described method may have significant practical advantages over a steel-based panel. The fiber reinforced polymer composite panels 100 are modular and easily movable due to their light weight (approximately 8-35 pounds per square foot), while being able to maintain a concentrated loading of 20-200 pounds per square inch. The fiber reinforced polymer composite panels 100 can be removed and relocated depending on usage requirements, and the equipment required to move the fiber reinforced polymer composite panels 100 can be relatively light-duty, as the weight of the fiber reinforced polymer composite panels 100 does not necessitate being lifted by heavy-duty equipment. Further, the elevated platform system 200 including the fiber reinforced polymer composite panels 100 can easily be transported using a variety of methods, including being lifted by helicopter, to otherwise inaccessible regions.

In embodiments of the fiber reinforced polymer composite panels 100 having electrically-conductive layers 135 that include a metallic mesh or a carbon-based veil, the electrically-conductive layers 135 are added to the dry fibrous material 134 during the lay-up. As the non-conductive matrix 136 material cures and solidifies, the electrically-conductive layers 135 will be integrated into the fiber reinforced polymer composite panels 100. In embodiments of the fiber reinforced polymer composite panels 100 having electrically-conductive layers 135 that include electrically-conductive particles dispersed in the non-conductive matrix 136, the electrically-conductive particles are mixed with the wet non-conductive matrix 136 material before it is introduced to the fibrous material 134. Portions of the non-conductive matrix 136 may be removed from the fiber reinforced polymer composite panels 100 in order to expose the electrically-conductive layers 135. After the portions of the non-conductive matrix 136 are removed from the fiber reinforced polymer composite panels 100, the electrically-conductive layers 135 will be at least partially embedded in the non-conductive matrix 136.

In some embodiments of the fiber reinforced polymer composite panels 100, a combination of materials forming the electrically-conductive layers 135 may be used. For example, electrically conductive additives may be used to form the electrically-conductive layer 135 along the upper deck side 138 of the fiber reinforced polymer composite panels 100, while metallic mesh or a carbon-based veil are incorporated into the regions of the fiber reinforced polymer composite panels 100 that contact the attachment cradles 214, completing an electrical conduction path 142 between the fiber reinforced polymer composite panel 110 and the attachment cradle 214.

Referring to FIG. 3, a wear surface 137 may be incorporated into the non-conductive matrix 136 along an upper deck side 138 of the fiber reinforced polymer composite panels 100. The wear surface 137 may be applied to the upper deck side 138 of the fiber reinforced polymer composite panels 100 in a liquid thermoset resin that is allowed to cure and solidify to form an upper surface of the fiber reinforced polymer composite panels 100. Additionally, electrically-conductive particles may be introduced to the liquid thermoset resin that contains the wear surface 137, allowing static electricity to dissipate along the electrically-conductive layers 135. The wear surface 137 provides a toughened surface over which equipment can be moved without damaging the underlying surfaces of the fiber reinforced polymer composite panels 100.

Further, the fiber reinforced polymer composite panels 100 may include electric heater coils 141 embedded in the non-conductive matrix 136 along the upper deck side 138. Electrical current may be introduced to the electric heater coils 141 to increase the temperature of the upper deck side 138 of the fiber reinforced polymer composite panels 100. The increased temperature of the upper deck side 138 of the fiber reinforced polymer composite panels 100 encourages melting of snow and/or ice.

Figure 4:
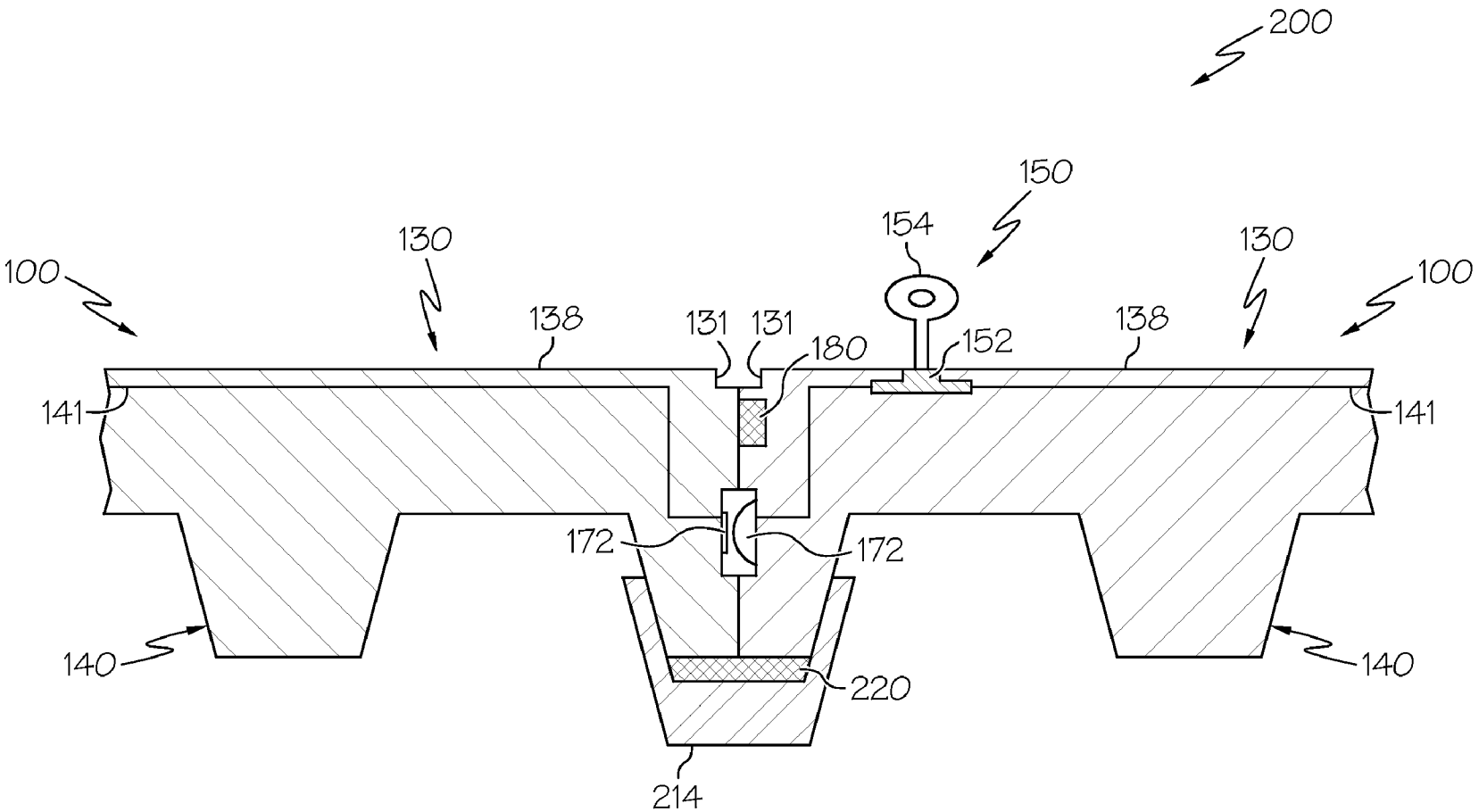
FIG. 4 depicts a sectional side view of the elevated platform system of FIG. 1 along line B-B.

Referring now to FIG. 4, the fiber reinforced polymer composite panels 100 may include drainage gutter portions 131. As illustrated, the drainage gutter portions 131 are located along the upper deck side 138 of the fiber reinforced polymer composite panels 100. The drainage gutter portions 131 allow for collection of liquids, for example, precipitation or spillage from an oil drilling process. The drainage gutter portions 131 may be interconnected as to direct any collected liquids away from the elevated platform system 200 and towards a liquid collection tank 230, as illustrated in FIG. 1. The liquid collection tank 230 is in fluid communication with the drainage gutter portions 131. Thus, any liquid that collects on the fiber reinforced polymer composite panels 100 of the elevated platform system 200 is collected in the liquid collection tank 230, and not prevented from being introduced to the environment.

Additionally, the elevated platform system 200 further includes a seal member 180 that forms a fluid-tight seal between adjacent fiber reinforced polymer composite panels 100. The seal member 180 may prevent any direct leakage of liquids from the top of the fiber reinforced polymer composite panels 100 to the environment.

As discussed hereinabove in regard to FIG. 3, some embodiments of the fiber reinforced polymer composite panels 100 include electric heater coils 141 along the upper deck side 138. For these embodiments, the fiber reinforced polymer composite panels 100 further include electrical connectors 172 that are in electrical continuity with the electric heater coils 141. The electrical connectors 172 may be located along the fiber reinforced polymer composite panels 100 such that electrical connectors 172 of adjacent fiber reinforced polymer composite panels 100 are in electrical continuity with one another.

The elevated platform system 200 may also include lifting features 150 that improve maneuverability and assembly of the fiber reinforced polymer composite panels 100. The lifting features 150 include lifting inserts 152 that are incorporated into the panel body portion 132 of the fiber reinforced polymer composite panels 100. The lifting features 150 may include eye-bolts 154 that can be secured to the lifting inserts 152. Lifting equipment can be secured to the eye-bolt 154, which allows for extraction of the fiber reinforced polymer composite panels 100 away from the base support structure 210 of the elevated platform system 200.

Referring back to FIG. 1, the elevated platform system 200 further includes a railing system 160 arranged around the periphery of the plurality of fiber reinforced polymer composite panels 100. The railing system 160 includes a plurality of stanchions 162 that are coupled to and extend from the fiber reinforced polymer composite panels 100, and a guard rail 164 that extends between the stanchions 162. The guard rail 164 may take the form of a guy-wire that extends along a side of the plurality of stanchions 162. The railing system 160 may be removed from the elevated platform system 200 on demand to allow for repositioning of equipment along the elevated platform system 200 or to ease snow or other debris removal from the plurality of fiber reinforced polymer composite panels 100.

Referring again to FIG. 2, when the elevated platform system 200 is assembled, the fiber reinforced polymer composite panels 100 are secured to the pilings 216 by coupling the fiber reinforced polymer composite panels 100 to the attachment cradles 214. Vibration damping cushions 220 are placed between the fiber reinforced polymer composite panels 100 and the attachment cradles 214 to provide compliance between the fiber reinforced polymer composite panels 100 and the attachment cradles 214. In some embodiments, the vibration damping cushions 220 are formed from an electrically-insulating material, for example, neoprene.

The fiber reinforced polymer composite panels 100 are positioned relative to the attachment cradles 214 such that the electrically-conductive layer 135 is in electrical continuity with the attachment cradles 214, and therefore the ground surface 80. The fiber reinforced polymer composite panels 100, therefore, do not require attachment of a separate "grounding strap" to place the fiber reinforced polymer composite panels 100 in electrical continuity with the ground surface 80. Instead, because of the attachment scheme provided by the base support structure 210, when the fiber reinforced polymer composite panels 100 are secured to the base support structure 210, the panels themselves are in electrical continuity with the ground surface 80. Thus, the electrical conduction path 142 formed between the fiber reinforced polymer composite panels 100 and the base support structure 210 extends from the upper deck side 138 to the lower deck side 139 of the fiber reinforced polymer composite panels 100 and, through contact with the attachment cradles 214, to the ground surface 80.

This may be beneficial to users of elevated platform systems for oil exploration, as fiber reinforced polymer composite panels 100 are regularly removed and replaced throughout a platform to access different areas of the ground surface 80. Thus, users of the elevated platform system 200 according to the present disclosure do not have to electrically connect the electrically-conductive layer 135 to the ground surface 80 in a separate step, thereby eliminating the possibility that the fiber reinforced polymer composite panel 100 will be electrically isolated from the ground surface 80.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An elevated platform system comprising a base support structure and a plurality of fiber reinforced polymer composite panels, wherein:

the base support structure comprises pilings secured to a ground surface and attachment cradles coupled to the pilings;

the attachment cradles are in electrical continuity with the ground surface;

the fiber reinforced polymer composite panels comprise a panel body portion, fibrous material surrounding the panel body portion, a non-conductive matrix forming at least a portion of an outer-most layer of the fiber reinforced polymer composite panel, and an electrically-conductive layer at least partially embedded in the non-conductive matrix and positioned proximate to an upper deck side as to dissipate static electricity from the upper deck side of the fiber reinforced polymer composite panel, the electrically-conductive layer forming an electronic conduction path from the upper deck side to a lower deck side of the fiber reinforced polymer composite panel; and the fiber reinforced polymer composite panels are coupled to the attachment cradles such that at least a portion of the electrically-conductive layers that are positioned proximate to the lower deck side of the fiber reinforced polymer composite panels are exposed from the non-conductive matrix and contact the attachment cradles to place the upper deck sides of the fiber reinforced polymer composite panels in electrical continuity with the ground surface.

2. The elevated platform system of claim 1, wherein the non-conductive matrix comprises a single or multi-component matrix of single or multi-layer construction.

3. The elevated platform system of claim 1, wherein the electrically-conductive layer comprises a metallic mesh.

4. The elevated platform system of claim 1, wherein the electrically-conductive layer comprises a carbon-based veil.

5. The elevated platform system of claim 1, wherein the electrically-conductive layer comprises electrically-conductive particles dispersed in the non-conductive matrix.

6. The elevated platform system of claim 1, wherein the fiber reinforced polymer composite panels further comprise a lifting insert incorporated into the panel body portion.

7. The elevated platform system of claim 1, wherein the non-conductive matrix comprises a wear surface located along an upper deck side of the fiber reinforced polymer composite panels.

8. The elevated platform system of claim 1 further comprising a seal member forming a fluid-tight seal between adjacent fiber reinforced polymer composite panels.

9. The elevated platform system of claim 1, wherein the fiber reinforced polymer composite panel further comprises a drainage gutter portion.

10. The elevated platform system of claim 9 further comprising a liquid collection tank in fluid communication with the drainage gutter portions of the fiber reinforced polymer composite panels.

11. The elevated platform system of claim 1 further comprising a railing system comprising a plurality of stanchions coupled to and extending from the fiber reinforced polymer composite panels and a guard rail extending between the stanchions.

12. The elevated platform system of claim 1, wherein the fiber reinforced polymer composite panel further comprises an electric heater coil located along an upper deck side.

13. The elevated platform system of claim 12, wherein:

the fiber reinforced polymer composite panels further comprise an electrical connector in electrical continuity with the electric heater coil; and the electrical connectors of adjacent fiber reinforced polymer composite panels are in electrical continuity with one another.

14. The elevated platform system of claim 1 further comprising a vibration damping cushion located between the fiber reinforced polymer composite panels and the attachment cradles.

15. The elevated platform system of claim 14, wherein the vibration damping cushion comprises an electrically-insulative material.

16. A fiber reinforced polymer composite panel comprising:

a panel body portion comprising a deck portion and a plurality of beam portions arranged along a lower deck side;

fibrous material surrounding the panel body portion;

a non-conductive matrix forming at least a portion of an outer-most layer of the fiber reinforced polymer composite panel; and an electrically-conductive layer at least partially embedded in the non-conductive matrix, the electrically-conductive layer forming an electronic conduction path from an upper deck side to the lower deck side of the fiber reinforced polymer composite panel, wherein at least a portion of the electrically-conductive layer of the fiber reinforced polymer composite panel that is positioned proximate to the lower deck side is exposed from the non-conductive matrix.

17. The fiber reinforced polymer composite panel of claim 16, wherein the non-conductive matrix comprises a wear surface located along an upper deck side of the deck portion.

18. The fiber reinforced polymer composite panel of claim 16, wherein the electrically-conductive layer comprises a metallic mesh.

19. The fiber reinforced polymer composite panel of claim 16, wherein the electrically-conductive layer comprises a carbon-based veil.

20. The fiber reinforced polymer composite panel of claim 16, wherein the electrically-conductive layer comprises electrically-conductive particles dispersed in the non-conductive matrix.

21. The elevated platform system of claim 1, wherein the electrically-conductive layer is exposed along the upper deck side of the fiber reinforced polymer composite panel.

22. The elevated platform system of claim 1, wherein the non-conductive matrix in which the electrically-conductive layer is embedded at positions proximate to the upper deck side of the fiber reinforced polymer composite panel allows static electricity to dissipate from the upper deck side through the non-conductive matrix and into the electrically-conductive layer.

23. The elevated platform system of claim 7, wherein the wear surface comprises electrically conductive particles that conduct static electricity from the upper deck side of the fiber reinforced polymer composite panel to the electrically-conductive layer.

* * * * *